US005455611A

United States Patent [19]

Simon et al.

[11] Patent Number: 5,455,611

[45] Date of Patent: Oct. 3, 1995

[54] FOUR INCH PRINT HEAD ASSEMBLY

[75] Inventors: Robert J. Simon, West Carrolton; Daniel R. Rudolf, Yellow Springs; James A. Katerberg, Kettering; David N. Pipkorn, Centerville, all of Ohio

[73] Assignee: Scitex Digital Printing, Inc., Dayton, Ohio

[21] Appl. No.: 891,335

[22] Filed: May 29, 1992

[51] Int. Cl.[6] ..... B41J 2/205

[52] U.S. Cl. ..... 347/49; 347/74

[58] Field of Search ..... 347/74, 49, 6, 347/89

[56] References Cited

U.S. PATENT DOCUMENTS

| | | | |
|---|---|---|---|
| 4,800,398 | 1/1989 | Naruse et al. | 347/74 X |
| 5,049,898 | 9/1991 | Arthur et al. | 347/49 X |
| 5,122,812 | 6/1992 | Hess et al. | 347/59 |
| 5,363,134 | 11/1994 | Barbehenn et al. | 347/49 |

FOREIGN PATENT DOCUMENTS

| | | | |
|---|---|---|---|
| 02-167755 | 6/1990 | Japan | 347/49 |

OTHER PUBLICATIONS

Robert A. Lonis; Storage of operating parameters in memory integral with printhead; Xerox Disclosure Journal; Nov./Dec. 1983; p. 503.

*Primary Examiner*—A. T. Grimley
*Assistant Examiner*—Nestor R. Ramirez
*Attorney, Agent, or Firm*—Barbara Joan Haushalter

[57] ABSTRACT

An apparatus and method allow for assembly of a print head apparatus for an ink jet printer. The apparatus comprises control capability for controlling the flow of fluid to the droplet generator and for controlling transfer of data to the droplet charging and collecting element. The control capability for controlling transfer of data to the droplet charging and collecting element is a motherboard containing various elements. The motherboard includes a microcontroller and fiber optics for receiving data and control signals and providing the signals to an input buffer. A RAM provides data memory, and a latch and shift register latch and shift the data from the RAM. A high voltage driver receive data from the latch and shift register. A control state machine communicates with the microcontroller, for handling generation of all control signals for the input buffer, the RAM, and the latch and shift register. Finally, opto couplers buffer the low voltage circuitry from high voltage circuitry in the print head apparatus. The print head apparatus is capable of providing diagnostic functions, and is self-contained in a field-replaceable housing.

21 Claims, 3 Drawing Sheets

FOUR INCH PRINT HEAD ASSEMBLY

TECHNICAL FIELD

The present invention relates to continuous ink jet printers and, more particularly, to assembling the components of an ink jet print head.

BACKGROUND ART

Ink jet printing systems are known in which a print head defines one or more rows of orifices which receive an electrically conductive recording fluid, such as for instance a water base ink, from a pressurized fluid supply manifold and eject the fluid in rows of parallel streams. Printers using such print heads accomplish graphic reproduction by selectively charging and deflecting the drops in each of the streams and depositing at least some of the drops on a print receiving medium, while others of the drops strike a drop catcher device.

In the prior art, it is known to have separate assemblies for each component of the ink jet printer. For example, there are separate assemblies for the orifice plate and the charge plate, and the components of each assembly. When an assembly needs to be replaced or repaired, there are several assemblies that need to be attended to. For instance, if a component of one assembly is replaced, the replacement component is required to be realigned with the various other components in the assembly. This, in turn, requires certain tools to be available to attempt the realignment. The process, therefore, is time consuming and costly, besides that realignment is extremely difficult to achieve.

In an effort to integrate the various components and assemblies, it is known in the prior art to contain several of the separate assemblies in a single housing. When a component had a problem, the entire assembly was removed from the housing. Unfortunately, this requires opening a housing, usually by removing various screw and attachment means, disconnecting electrical connectors between the separate assemblies within the housing, removing the problematic assembly, installing the replacement assembly, and putting the housing back together with the screw and attachment means. Obviously, the process has the disadvantage of being extremely time-consuming.

It is seen then that there is a need for a print head assembly which can be quickly and easily replaced, even in the field, and which is completely self-contained.

SUMMARY OF THE INVENTION

This need is met by the assembly means and method according to the present invention, wherein a self-contained print head apparatus is assembled.

In accordance with one aspect of the present invention, a print head apparatus for an ink jet printer comprises a droplet generating means and a means for providing fluid to the droplet generating means. The apparatus further comprises a means for charging and collecting drops from the droplet generating means and a means for providing data signals to the means for charging and collecting drops. Finally, a housing means contains the print head apparatus.

DETAILED DESCRIPTION OF THE PREFERRED EMBODIMENTS

Figure 1:
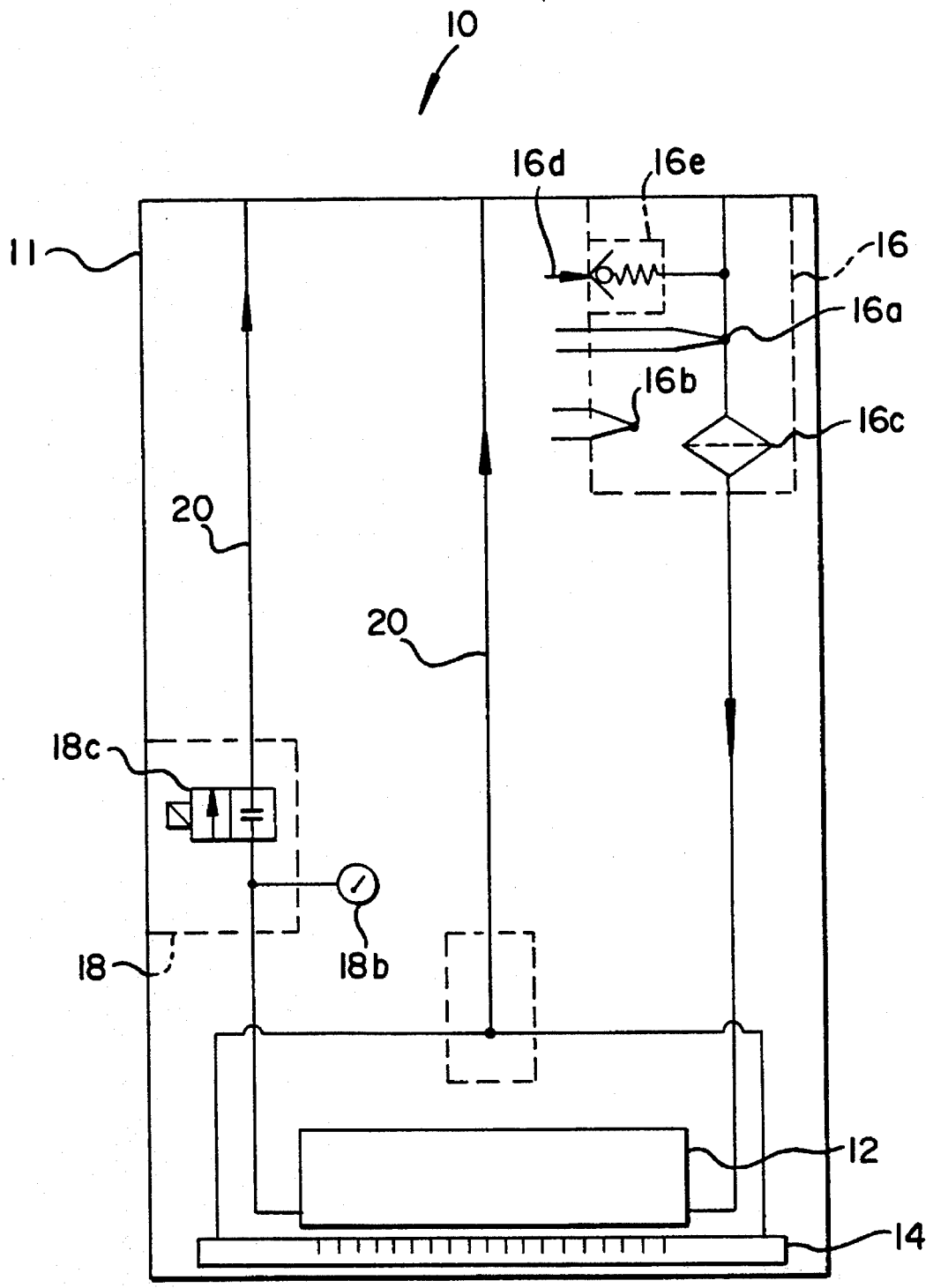
FIG. 1 is a schematic diagram illustrating components and fluid paths within an ink jet print head.

The present invention provides for a four inch print head assembly which provides a minimum package size and minimizes operator interventions. Ink jet printers are typically comprised of several components, including a fluid system, data system, and print head. The fluid system provides electrical control of the components required to control drop formation and maintain fluid quality. The print head, which accepts fluids from the fluid system, generates drops and returns unused drops to the fluid system. The print head selectively controls drop charging to allow imaging on a print medium, utilizing information prepared by the data system. The data system accepts data in standard formats, such as ASCII, EBCDIC, etc., along with print start and delay signals. The information is transferred to the print head for imaging.

In the drawings, for purposes of illustration only, components within a preferred embodiment of a print head have been expanded from what is typical for a continuous ink jet printer print head to include all the control sensors required for maintaining drop quality. The drawings will be described with reference to a preferred embodiment of the present invention, wherein the preferred embodiment is a four inch printer which incorporates 1024 printing jets, but are not to be considered as limiting the invention.

Referring now to FIG. 1, a print head assembly 10 is enclosed in a housing means or enclosure 11. The housing means 11 houses a droplet generator means 12 which has been previously coupled to a droplet charging and collecting means 14. Filtered fluids are provided to the droplet generator means 12 via a supply manifold 16 which contains an ink temperature sensor **16*a*, an ambient temperature sensor 16*b*, a final filter assembly 16*c*, and an airflow path 16*d*. The airflow path 16*d* is sealed from leaking ink by a spring biased check valve 16*e* which will allow an airflow through the droplet generator means 12** during the print head shutdown sequence to accelerate removal and drying of ink. This is particularly advantageous for overnight storage and transportation.

Continuing with FIG. 1, ambient and ink temperature sensors, **16*a* and 16*b* respectively, can be utilized by an external controller to provide ink at a fixed temperature relative to the surroundings. This is utilized for condensate cleaning of the drop charging and collecting means 14** during startup conditions. This could also be utilized during normal run operations.

An outlet manifold assembly 18 houses a pressure measuring means **18*b* for precisely controlling the pressure at which drops are generated, as well as an outlet valve 18*c*. The outlet valve 18*c* is activated to provide a high flow rate through the droplet generator means 12 during startup for dissolving ink and wetting the orifice plate. The valve 18*c* is deactivated to close the exit path and provide for a pressure sufficient for droplet formation. During each of these operations the pressure in the droplet generator means 12 is monitored for servo control via the pressure measuring means 18*b*. During cross flush conditions, a small positive pressure is maintained, typically 0.5 to 1.0 psig, to prevent air ingestion into the droplet generator means 12** where air can become trapped. The trapped air would then prevent uniform drop generation.

Figure 2:
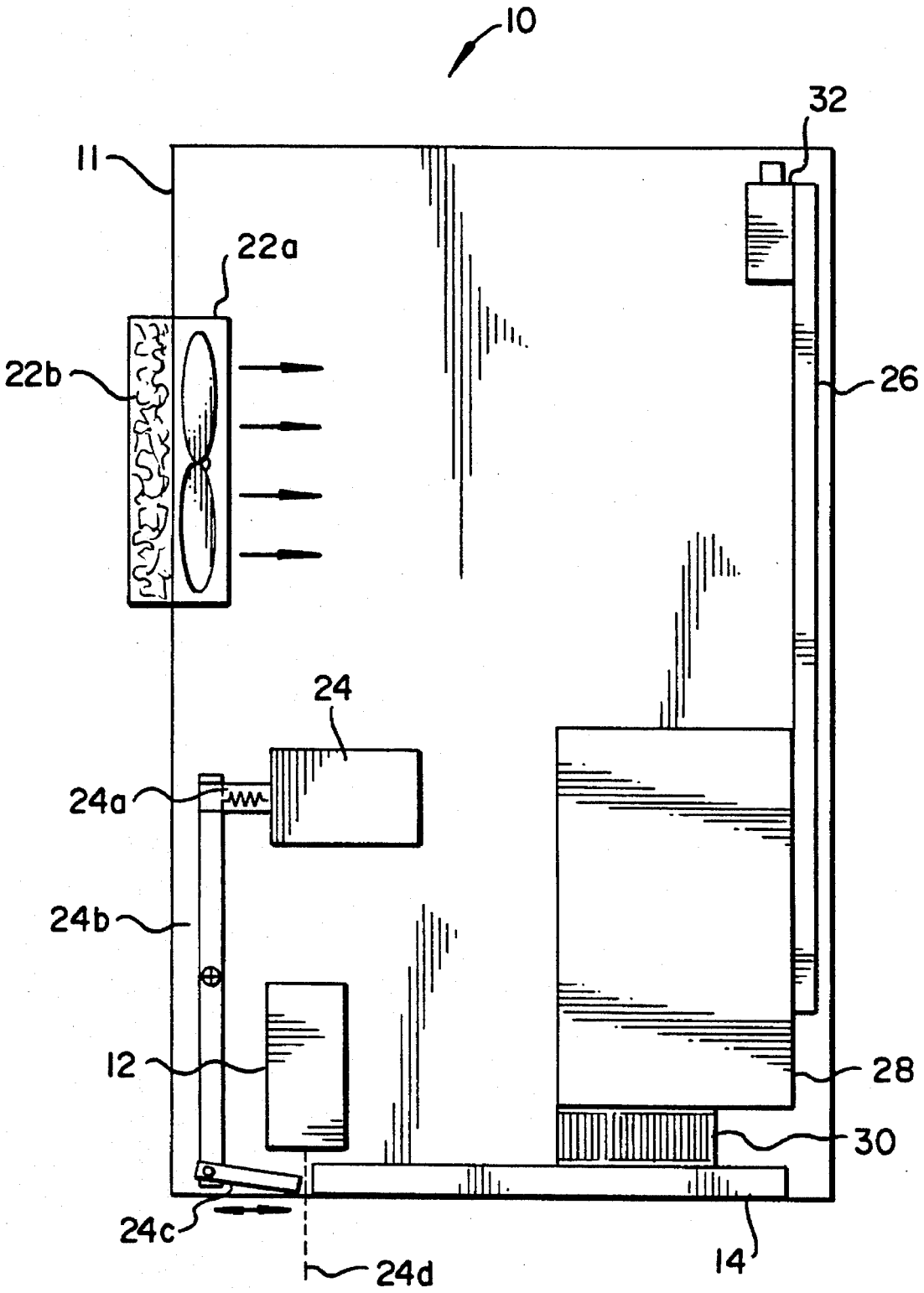
FIG. 2 is a schematic diagram illustrating the airflow path and electronic control features within the print head.

Referring now to FIG. 2 and continuing with FIG. 1, an eyelid 24*c* is used in the closed position to divert ink into the drop collection means 14 for removal via a flow path 20 during the start up and shut down conditions. In the normal operating (printing) condition, the eyelid 24*c* is opened to allow the selected drops to strike a print medium 24*d*. The eyelid 24*c* is activated (opened) using an electromechanical solenoid 24 connected to a link 24*b* which pivots at pivot point 24*c*. A spring bias 24*a* is used close the eyelid 24*c* against the drop charging and collecting means 14. Placement of the activation components away from the ink usage area prevents ink from drying on the pivots, etc. where they could cause sticking or binding of the eyelid motion.

The print head assembly 10 is fully enclosed by the housing means 11 except for small gaps in the region of the moving eyelid 24. The small gaps allow positive air pressure to be maintained within the assembly 10 when a fan 22*a* is installed within the assembly 10. Previous systems have provided air from the fluid system, which requires larger pumps to account for line losses and directional control of the inlet air supply. The fan 22*a* of the present invention provides an air turnover rate of about 3 times/minute. The air is cleaned by a filter 22*b* which is located external to the print head assembly 10 to allow for quick removal and cleaning. The use of this pressurized flow of filtered air within the print head housing helps to keep paper dust and other dirt out of the print head where the debris can cause print head failures. The positive air is also utilized for cooling electronic components contained within the print head housing.

Figure 3:
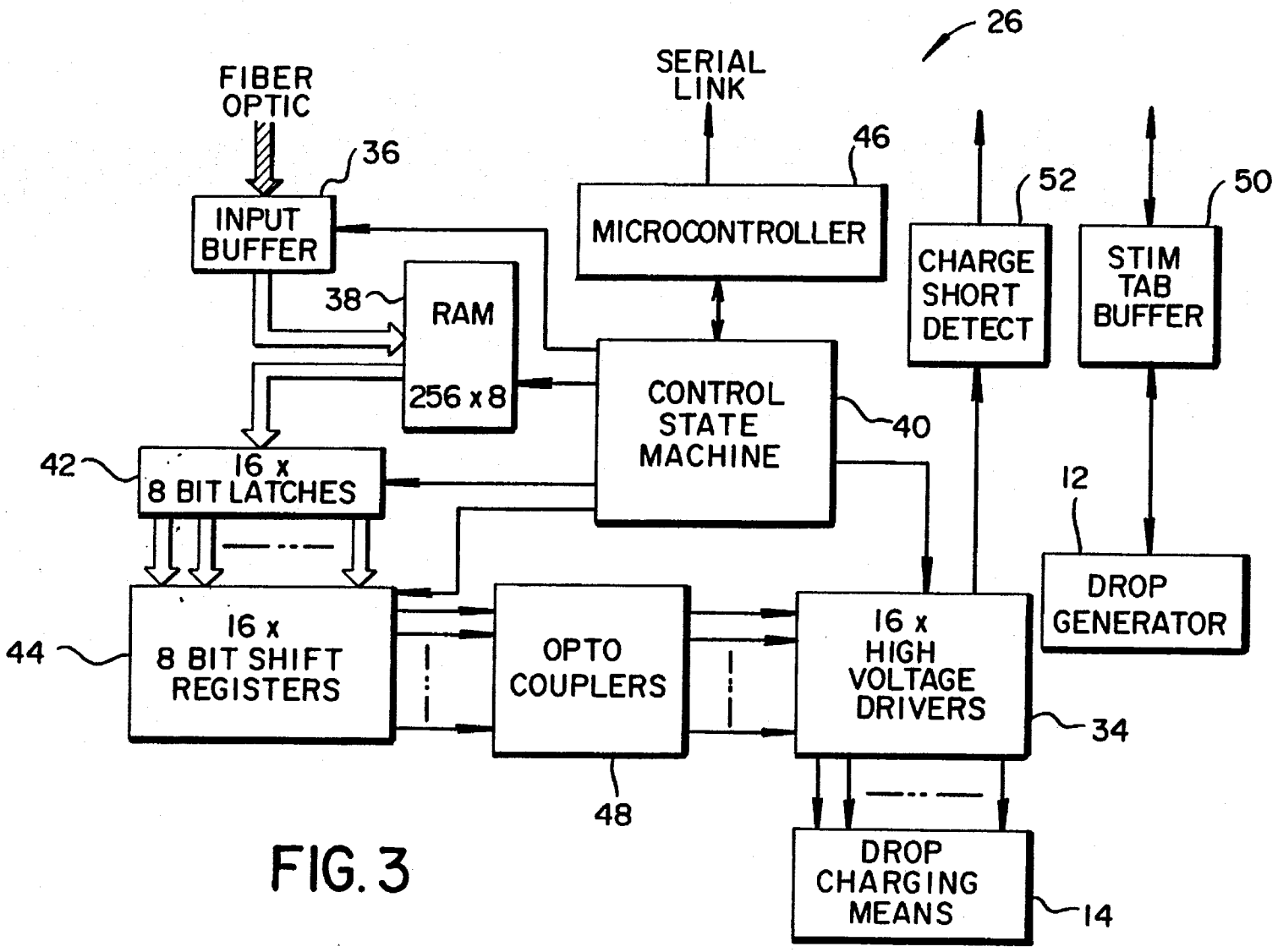
FIG. 3 is a block diagram of a motherboard for the four inch print head of the present invention.

Referring now to FIG. 3 and continuing with FIG. 2, the print head motherboard 26 resides in the print head housing 11 and connects to the fluid system, the data system, and the print head. The motherboard 26 takes print data from the data system, combines it with timing data from the fluid system, and converts it to a format suitable for high voltage drivers 34 located on charge driver boards 28 which drive the print head. The interface from the data system to the motherboard 26 is preferably accomplished through a fiber optic cable means 32 driven by a fiber optic transmitter (not shown) in the data system. The charge driver boards 28 are connected to the drop charging and collecting means via a flexible connection 30. A clock to a fiber optic receiver of an input buffer block 36 of FIG. 3 is 12.5M Hz.

The input buffer block 36 of the motherboard 26 contains the fiber optic receiver, an input latch, input FIFO, and two buffers. Data and control signals are transmitted by the data system over a fiber optic link to the fiber optic receiver. The fiber optic receiver preferably puts the data out 8 bits at a time with a data strobe.

Continuing with FIG. 3, the input buffer 36 provides control signals to a RAM 38. The RAM 38, located on the motherboard 26, is preferably a 2K by 8 bit high speed static RAM. Only 256 bytes are used to store two lines of print data. The RAM 38 is divided into an upper section and a lower section. A first line of data read from the input FIFO of the input buffer 36 is written into the lower section, the second line is written into the upper section, the third line is written into the lower, and so on. Data is written into the RAM 38 in sequential order from the lowest order address to the highest order address in each section. When a section has been filled with raster data, on the next TACH cycle data will be read from that section of RAM, address 00 byte first, address 08 byte second, address 0F byte third, and so on. Data is read until the count wraps around and the address 01 byte is read, then the address 09 byte etc., counting by eight each time. This is done until all 128 bytes in that section has been read the same way.

In FIG. 3, a control state machine 40 is a RAM based device that on powerup loads its configuration from an external serial PROM. The configuration PROM is socketed to allow hardware upgrades to be done without modifying the circuit board. The PROM also allows upgrades to be done in the field. The control state machine 40 can also be configured over an external serial cable from a development system connected to a jumper. The control state machine 40 handles the generation of all the control signals for the input buffer 36, the RAM 38, data latches 42, and shift registers 44. It also includes control and status communication to a microcontroller 46, the syncing of print pulses with the phase signals coming from the fluid system, and the generation of the strobes for the charge driver boards 28. An external 25M HZ oscillator (not shown) drives the control state machine 40 and most of the internal logic operates at that frequency.

Continuing with FIG. 3, data that is read from the RAM 38 is latched into sixteen eight bit latches 42 associated with the control state machine 40. The data from the sixteen latches 42 is transferred, all at one time to the shift registers 44. The shift register block 44 preferably consists of sixteen eight bit shift registers also associated with the control state machine 40. Data is shifted out 16 bits wide, in eight bit chunks, with a data strobe to the sixteen high voltage drivers 34. A total of 64 bits, sixteen bits wide, is shifted.

As illustrated in FIG. 3, data that is transferred from the shift registers 44 to the high voltage drivers 34 is buffered through opto couplers 48. The opto couplers 48 buffer the low voltage section of circuitry on the motherboard 26 from the high voltage section at charge drivers 28. The opto couplers also provide noise immunity and level shifting from 5 volt logic to 12 volt logic.

The high voltage drivers 34 are not technically located on the motherboard 26, but rather are located on daughter boards, defined as charge voltage driver boards 28 and shown in FIG. 2, that plug into the motherboard 26, and are shown in this schematic as part of the motherboard 26 for purposes of description only. The mother board 26 connects to the print head via a plurality of, preferably eight, charge driver boards 28, each of which incorporates two high voltage charge driver chips. In the preferred embodiment, there are charge driver boards 28, each having two high voltage drivers 34.

In ink jet printers, the charge and therefore the deflection of a drop depends in the voltage on the charge plate just prior to the break off of the drops. A drop will only be charged for catch if the charge voltage is high during the very short interval just prior to break off. Conversely, a drop will be left uncharged for print only if the charge voltage is near zero during this time interval. To ensure proper selection of the print drops, it is necessary to maintain proper phase between the print pulses and the break off of drops. To aid the operator in selecting the optimum phase, the microprocessor 46 can generate a diagnostic plot of the stimulation break off phase for each array of jets. From this plot, the operator can readily select the desired operating phase. This plot also provides a check on stimulation uniformity which may indicate a degradation in the drop generator 12.

The motherboard 26 also acts as a pass through for a number of fluid system control lines to components such as solenoids and thermistors. A stimulation tab buffer 50 receives the low level signal from the feedback tab of the drop generator 12 and amplifies it. This ensures that the stimulation tab signal which is used by the fluid system electronics to servo the stimulation amplitude is kept relatively free of noise pick up.

Continuing with FIG. 3, charge short detect circuitry 52 detects charge shorts by detecting current to each of the charge driver cards at block 28. The current detect signal is then gated or filtered to pass a short detect signal only when the charge driver circuits of block 28 should not be drawing any current. In this way, the current drawn by the charge driver circuitry during printing does not produce false short detect signals. The charge short signal is sent to the fluid system which then takes corrective action.

The motherboard 26 includes the microcontroller 46 which does status monitoring, and selftest control, and contains EEPROM storage for specific fluid system parameters. The microcontroller 46 communicates with the fluid system over a bidirectional serial link 44. The microcontroller 46 is used to store print head specific fluid system parameters, provide a serial interface to the fluid system, transfer status and commands to and from the fluid system, and control the on board selftest and charge short detect selftest. On powerup of the print head, the microcontroller 46 sets up for selftest, wherein a line of data to the input buffer 36 is written. The microcontroller 46 then provides strobes to transfer the data through the data path of the motherboard 26, intercepting the modified data just before the opto couplers 48. The microcontroller 46 then compares the data received to calculated values to verify whether the self-test passed.

Continuing with FIG. 3, the microcontroller 46 also forces a charge short and examines the "charge short" line to verify a portion of the charge short detect logic at block 52. The selftest tests 60–70% of the logic on the motherboard 26. The microcontroller 46 may be placed in bootstrap mode using a jumper, whereby firmware upgrades may be down loaded from the fluid system or from a PC with an adapter cable. The jumper is then removed, the power cycled, and the microcontroller 46 may then execute the new firmware loaded.

In the preferred embodiment of the present invention, the print head assembly is controlled by a fluid system utilizing parameters within the print head. The print head accepts data via a fiber optic link from a data system to ultimately control print drop selection.

Although the preferred mode of practicing the invention has been described with reference to an ink jet print head for a continuous ink jet printer, the principle of the present invention can also be applied to a wide variety of ink jet printers.

Industrial Applicability and Advantages

The print head assembly apparatus according to the present invention is useful in continuous ink jet printers. The apparatus of the present invention provides for an entirely self-contained print head assembly. The print head of the present invention has the further advantage of being able to store operating (initial and final) parameters. This advantage, in turn, provides the additional advantage of allowing for easy replacement of the print head assembly, even in the field.

Having described the invention in detail and by reference to the preferred embodiment thereof, it will be apparent that other modifications and variations are possible without departing from the scope of the invention defined in the appended claims.

The invention claimed is:

1. A print head apparatus for an ink jet printer comprising:

a. a means for generating droplets;

b. a means for providing fluid to the means for generating droplets;

c. a means for charging and collecting drops from the means for generating droplets;

d. a motherboard for converting data signals for controlling the means for charging and collecting drops, the motherboard including a microcontroller, fiber optic means for receiving data and control signals and providing the signals to an input buffer, a RAM for providing data memory, latch and shift register means for latching and shifting data from the RAM, high voltage driver means for receiving data from the latch and shift register means, a control state machine, which communicates with the microcontroller, for handling generation of all control signals for the input buffer, the RAM, and the latch and shift register means, and opto couplers for buffering low voltage circuitry from high voltage circuitry; and e. a field-replaceable housing means for containing the print head apparatus.

2. A print head apparatus as claimed in claim 1 wherein the control state machine is configured to allow hardware upgrades.

3. A print head apparatus as claimed in claim 1 further comprising means for controlling print quality.

4. A print head apparatus as claimed in claim 3 wherein the means for controlling droplet quality comprises:

a. means for measuring ink pressure;

b. means for measuring ink temperature; and c. means for measuring a stimulation level.

5. A print head apparatus as claimed in claim 4 wherein the means for measuring a stimulation level comprises means for isolating and amplifying a control signal to provide sufficient signal level over a long distance.

6. A print head apparatus as claimed in claim 1 wherein the data signals comprise charging and collecting signals.

7. A print head apparatus as claimed in claim 1 wherein the data signals comprise print signals.

8. A print head apparatus for an ink jet printer including a droplet generator and a droplet charging and collecting means, the apparatus comprising:

a. a means for controlling the flow of fluid to the droplet generator;

b. a means for controlling transfer of data to the droplet charging and collecting means;

c. a means for providing diagnostic functions on the print head apparatus; and d. a field-replaceable housing means for containing the print head apparatus.

9. A print head apparatus as claimed in claim 8 wherein the means for controlling the flow of fluid to the droplet generator comprises an inlet manifold.

10. A print head apparatus as claimed in claim 9 wherein the inlet manifold comprises:

a. means for measuring ink temperature;

b. means for measuring ambient temperature; and c. means for filtering an input fluid to a desired level.

11. A print head apparatus as claimed in claim 9 wherein the means for controlling transfer of data to the droplet charging and collecting means comprises a data manipulation means.

12. A print head apparatus as claimed in claim 11 wherein the data manipulation means comprises means for sorting serial data into multiple parallel streams of serial data.

13. A print head apparatus as claimed in claim 11 wherein the data manipulation means comprises a motherboard.

14. A print head apparatus as claimed in claim 13 wherein the motherboard comprises:

a. a microcontroller;

b. fiber optic means for receiving data and control signals and providing the signals to an input buffer;

c. a RAM for providing data memory;

d. latch and shift register means for latching and shifting data from the RAM;

e. high voltage driver means for receiving data from the latch and shift register means;

f. a control state machine which communicates with the microcontroller, for handling generation of all control signals for the input buffer, the RAM, and the latch and shift register means; and g. opto couplers for buffering low voltage circuitry from high voltage circuitry.

15. A print head apparatus as claimed in claim 8 wherein the means for providing diagnostic functions comprises means for printing out stimulation uniformity plots.

16. A print head apparatus as claimed in claim 8 wherein the means for providing diagnostic functions comprises means for storing print head operation data.

17. A print head apparatus as claimed in claim 8 wherein the means for providing diagnostic functions comprises means for conducting a selftest of short detect circuitry.

18. A print head apparatus as claimed in claim 8 further comprising an air flow path for allowing removal of fluid from the means for generating droplets and further for allowing drying of the means for generating droplets.

19. A print head apparatus as claimed in claim 8 further comprising a means for maintaining jet quality.

20. A print head apparatus as claimed in claim 8 wherein the means for maintaining jet quality comprises means for generating positive air to a print head of the print head apparatus.

21. A print head apparatus as claimed in claim 20 wherein the means for generating positive air to a print head comprises a fan for allowing positive air pressure to be maintained within the print head assembly.

* * * * *